US007659218B2

(12) United States Patent
Nishiguchi et al.

(10) Patent No.: US 7,659,218 B2
(45) Date of Patent: Feb. 9, 2010

(54) STRETCH NONWOVEN FABRIC AND METHOD FOR PRODUCTION THEREOF

(75) Inventors: Daisuke Nishiguchi, Sodegaura (JP); Kenichi Suzuki, Sodegaura (JP); Satoshi Yamasaki, Sodegaura (JP); Shigeyuki Motomura, Sodegaura (JP); Hisashi Kawanabe, Sodegaura (JP)

(73) Assignee: Mitsui Chemicals, Inc, Tokyo (JP)

( * ) Notice: Subject to any disclaimer, the term of this patent is extended or adjusted under 35 U.S.C. 154(b) by 321 days.

(21) Appl. No.: 10/543,246

(22) PCT Filed: Jan. 23, 2004

(86) PCT No.: PCT/JP2004/000568

§ 371 (c)(1),
(2), (4) Date: Jul. 22, 2005

(87) PCT Pub. No.: WO2004/065679

PCT Pub. Date: Aug. 5, 2004

(65) Prior Publication Data

US 2006/0141883 A1 Jun. 29, 2006

(30) Foreign Application Priority Data

Jan. 24, 2003 (JP) ..... 2003-016803

(51) Int. Cl.

| | |
|---|---|
| ***D04H 3/16*** | (2006.01) |
| ***D04H 1/00*** | (2006.01) |
| ***D04H 3/00*** | (2006.01) |
| ***D04H 1/46*** | (2006.01) |

(52) U.S. Cl. ..... 442/401; 442/328; 442/329; 442/407

(58) Field of Classification Search ..... 442/328, 442/329, 375, 401, 407
See application file for complete search history.

(56) References Cited

FOREIGN PATENT DOCUMENTS

| | | |
|---|---|---|
| EP | 1043438 A1 | 10/2000 |
| JP | 07-503502 | 4/1995 |
| JP | 09-087358 | 3/1997 |
| JP | 09-291454 | 11/1997 |
| JP | 2002-522653 | 7/2002 |
| WO | WO 93/15251 | 8/1993 |
| WO | WO 99/39037 | 8/1999 |
| WO | WO 00/08243 A1 | 2/2000 |

OTHER PUBLICATIONS

International Search Report for PCT/JP2004/000568 dated Apr. 20, 2004.

*Primary Examiner*—Lynda Salvatore
(74) *Attorney, Agent, or Firm*—Turocy & Watson, LLP

(57) ABSTRACT

A spunbonded elastic nonwoven fabric according to the invention comprises fibers formed from a polymer comprising a thermoplastic polyurethane elastomer, wherein the thermoplastic polyurethane elastomer has a starting temperature for solidifying of 65° C. or above as measured by a differential scanning calorimeter (DSC) and contains $3.00\times10^6$ or less polar-solvent-insoluble particles per g as counted on a particle size distribution analyzer, which is based on an electrical sensing zone method, equipped with an aperture tube having an orifice of 100 μm in diameter, and wherein the fibers have diameters such that the standard deviation of fiber diameters (Sn) divided by the average fiber diameter ($X_{ave}$) ($Sn/X_{ave}$) gives a value of 0.15 or less.

11 Claims, No Drawings

STRETCH NONWOVEN FABRIC AND METHOD FOR PRODUCTION THEREOF

FIELD OF THE INVENTION

The present invention relates to an elastic nonwoven fabric obtainable by spunbonding a polymer that contains a thermoplastic polyurethane elastomer, a production method for the same, and a hygiene material including the elastic nonwoven fabric.

BACKGROUND OF THE INVENTION

Elastic nonwoven fabrics made from thermoplastic polyurethane elastomers (hereinafter "TPU") proposed so far have been used in applications including garments, hygiene materials and materials for sporting goods due to their high elasticity, low residual strain and superior breathability.

Meltblowing is a typical process for producing elastic nonwoven fabrics from TPU. Meltblown elastic nonwoven fabrics exhibit high elasticity, flexibility and breathability, and therefore they have been used in relatively active applications that require conformity to body movements, such as side bands in disposable diapers, gauze pads in adhesive bandages, and disposable gloves.

JP-A-7-503502 discloses a spunbonded nonwoven fabric comprising a web of elastomeric thermoplastic substantially continuous filaments. This spunbonded nonwoven fabric is mentioned to have a more pleasant feel than meltblown nonwoven fabrics because they more closely approximate textile fiber diameters and consequently textile-like drape and hand. JP-A-7-503502 describes thermoplastic polyurethane elastomers as the thermoplastic elastomers, but it is not disclosed starting temperatures for solidifying of these elastomers and particle number of polar-solvent insolubles. As will be illustrated in Comparative Examples 1 and 2 of this specification, fibers will break and adhere to one another during spinning when the thermoplastic elastomer has a starting temperature for solidifying of less than 60° C., or contains over $3.00\times10^6$ particles of polar-solvent insolubles per g of the elastomer; the result is a nonwoven fabric having bad touch.

JP-A-9-87358 discloses a thermoplastic polyurethane resin that contains, per g of the resin, $2\times10^4$ or less particles of polar-solvent insolubles ranging from 6 to 80 μm in particle diameters. This thermoplastic polyurethane resin has been shown to be useful for producing elastic polyurethane fibers without causing any increase in nozzle back pressure and any filament breakage during the melt spinning. The present inventors have tried to produced the thermoplastic polyurethane resin according to JP-A-9-87358, but they cannot obtain it.

JP-A-2002-522653 addresses the characteristic "sticky" nature of the thermoplastic elastomers as one of the problems encountered in spunbonding the elastomers into nonwoven fabrics. It has been pointed out that turbulence in the air can bring filaments into contact and they can adhere to one another in the spunbonding. The "stickiness" has been proven to be especially troublesome during rolling up of the webs. Further, JP-A-2002-522653 mentions breakage and elastic failure of the strand during extrusion and/or stretching. As will be illustrated in Comparative Example 2 of this specification, spinning TPU (Elastollan 1180A (BASF Japan Ltd.)) described in JP-A-2002-522653 is accompanied with filament breakage and the resultant nonwoven fabric is unsatisfactory.

WO99/39037 discloses an elastic nonwoven fabric comprised of a thermoplastic polyurethane resin that has a hardness (JIS-A hardness) of 65 A to 98 A and a fluidization initiation temperature of 80 to 150° C. This nonwoven fabric is obtained by stacking continuous filaments of a thermoplastic polyurethane resin into a sheet form and fusion-bonding the stacked filaments at the contact points by their own heat. This production is the meltblowing. The present inventors performed the procedure described in WO99/39037 to prepare a thermoplastic polyurethane resin and used it in Comparative Example 4 to form a spunbonded nonwoven fabric. The result was filament breakage during the spinning and the resultant nonwoven fabric was of inferior quality.

JP-A-9-291454 discloses elastic nonwoven fabrics, having excellent drape, comprising a conjugate fiber comprising a crystalline polypropylene and a thermoplastic elastomer. It discloses an elastic nonwoven fabric which comprises a concentric sheath-core conjugate fiber made up of 50 wt % of a urethane elastomer as the core and 50 wt % of a polypropylene as the sheath (Example 6). The disclosure extends to an elastic nonwoven fabric which comprises a conjugate fiber made up of 50 wt % of a urethane elastomer and 50 wt % of a polypropylene to show a six-segmented cross section (Example 8). These nonwoven fabrics are produced by opening staple fibers with a carder and heating them with a through-air dryer. They are capable of about 75% elastic recovery after 20% elongation and have excellent drape. However, they are still insufficient in elastic properties for applications such as garments, hygiene materials and materials for sporting goods.

OBJECT OF THE INVENTION

The present invention is aimed at solving the aforesaid problems associated with the background art. Thus, it is an object of the invention to provide an elastic nonwoven fabric that is obtained by spunbonding a polymer containing a thermoplastic polyurethane elastomer and has pleasant touch, high elasticity and small residual strain. It is another object of the invention to provide a production method for the elastic nonwoven fabric.

DISCLOSURE OF THE INVENTION

The present inventors earnestly studied to overcome the aforesaid problems, and completed the present invention based on the finding that the use of a thermoplastic polyurethane elastomer having a specific starting temperature for solidifying and a specific content of polar-solvent insolubles can lead to a nonwoven fabric that has narrow fiber diameter distribution and as a consequence has pleasant touch.

An elastic nonwoven fabric according to the invention is a spunbonded elastic nonwoven fabric comprising fibers formed from a polymer comprising a thermoplastic polyurethane elastomer, said thermoplastic polyurethane elastomer having a starting temperature for solidifying of 65° C. or above as measured by a differential scanning calorimeter (DSC) and containing $3.00\times10^6$ or less polar-solvent-insoluble particles per g as counted on a particle size distribution analyzer, which is based on an electrical sensing zone method, equipped with an aperture tube having an orifice of 100 μm in diameter, and said fibers having diameters such that the standard deviation of fiber diameters (Sn) divided by the average fiber diameter ($X_{ave}$) ($Sn/X_{ave}$) gives a value of 0.15 or less.

The polymer preferably contains the thermoplastic polyurethane elastomer in an amount of 0.10 wt % or more.

On the thermoplastic polyurethane elastomer, a total heat of fusion (a) determined from endothermic peaks within the temperature range of from 90 to 140° C. and a total heat of fusion (b) determined from endothermic peaks within the temperature range of from above 140 to 220° C., which are measured by a differential scanning calorimeter (DSC), preferably satisfy the following relation (1):

$$a/(a+b)\times 100 \leqq 80 \quad (1).$$

A hygiene material according to the invention includes the elastic nonwoven fabric.

A production method for elastic nonwoven fabrics according to the invention comprises fibers formed from a polymer comprising a thermoplastic polyurethane elastomer by spunbonding the polymer wherein the thermoplastic polyurethane elastomer has a starting temperature for solidifying of 65° C. or above as measured by a differential scanning calorimeter (DSC) and contains $3.00\times10^6$ or less polar-solvent-insoluble particles per g as counted on a particle size distribution analyzer, which is based on an electrical sensing zone method, equipped with an aperture tube having an orifice of 100 μm in diameter, and wherein the fibers have diameters such that the standard deviation of fiber diameters (Sn) divided by the average fiber diameter ($X_{ave}$) ($Sn/X_{ave}$) gives a value of 0.15 or less.

A spunbonding processible thermoplastic polyurethane elastomer according to the invention has a starting temperature for solidifying of 65° C. or above as measured by a differential scanning calorimeter (DSC), contains $3.00\times10^6$ or less polar-solvent-insoluble particles per g as counted on a particle size distribution analyzer, which is based on an electrical sensing zone method, equipped with an aperture tube having an orifice of 100 μm in diameter, and enables production of spunbonded elastic nonwoven fabrics in which the standard deviation of fiber diameters (Sn) divided by the average fiber diameter ($X_{ave}$) ($Sn/X_{ave}$) gives a value of 0.15 or less.

EFFECT OF THE INVENTION

Spunbonding a polymer can be performed stably with no filament breakage and no fibers adhering one another or adhering to the spinning tower wall, by incorporating the polymer with a thermoplastic polyurethane elastomer that has a specific starting temperature for solidifying and a specific content of polar-solvent insolubles. Also, the use of the thermoplastic polyurethane elastomer leads to fiber diameters with narrow distribution so that the resultant spunbonded nonwoven fabric can display excellent touch.

PREFERRED EMBODIMENTS OF THE INVENTION

Elastic Nonwoven Fabric

The elastic nonwoven fabric of the invention is obtained by spunbonding a polymer that contains a thermoplastic polyurethane elastomer with a specific starting temperature for solidifying and a specific content of polar-solvent insolubles. The nonwoven fabric has a fiber diameter distribution within a certain range.

<Thermoplastic Polyurethane Elastomer>

The thermoplastic polyurethane elastomer (TPU) has a starting temperature for solidifying of 65° C. or above, preferably 75° C. or above, and optimally 85° C. or above. The upper limit on the starting temperature for solidifying is preferably 195° C. The starting temperature for solidifying as used herein is measured by a differential scanning calorimeter (DSC), and is a temperature at which an exothermic peak attributed to solidification of the TPU appears while the TPU is being cooled at a rate of 10° C./min after heated to 230° C. at a rate of 10° C./min and at 230° C. for 5 minutes. The TPU having a starting temperature for solidifying of 65° C. or above can prevent defects such as fusion bonded fibers, broken filaments and resin masses in the spunbonding, and can prevent nonwoven fabrics to adhere to a embossing roll in a thermal embossing. In addition, the resultant nonwoven fabrics are less sticky, so that they are suitably used in materials which bring into contact with a skin, such as garments, hygiene materials and materials for sporting goods. On the other hand, when the TPU has a starting temperature for solidifying of 195° C. or below, the processing properties are improved. A starting temperature for solidifying of a fiber tends to be higher than that of the TPU used.

In order that the TPU can have a starting temperature for solidifying of not less than 65° C., optimum chemical structures are to be selected for its materials: a polyol, an isocyanate compound and a chain extender. In addition, the amount of hard segments should be carefully controlled. The amount of hard segments (wt %) is determined by dividing the total weight of the isocyanate compound and the chain extender with the total weight of the polyol, the isocyanate compound and the chain extender, and centuplicating the quotient. The amount of hard segments is preferably 20 to 60 wt %, more preferably 22 to 50 wt %, and optimally 25 to 48 wt %.

In the TPU, particles that are insoluble in a polar solvent totals $3.00\times10^6$ or less per g of TPU, preferably $2.50\times10^6$ or less per g of TPU, and optimally $2.00\times10^6$ or less per g of TPU. The polar-solvent insolubles are mainly aggregates such as fish-eyes and gels that are generated in a TPU production. The aggregates are components derived from the materials for the TPU and reaction products among those materials. Examples of such polar-solvent insolubles include derivatives from agglomerated hard segments, and hard segments and/or soft segments crosslinked together through allophanate linkages or biuret linkages.

The polar-solvent-insoluble particles are the insolubles occurring when the TPU is dissolved in dimethylacetamide (hereinafter "DMAC") as a solvent. They are counted on a particle size distribution analyzer, which utilizes an electrical sensing zone method, with an aperture tube 100 μm in diameter. The aperture tube having a 100 μm pore can allow detection of particles which are 2 to 60 μm in terms of uncrosslinked polystyrene, and those particles are counted. The present inventors have found that the particle sizes in this range are closely related to the spinning stability for TPU-containing fiber and the quality of the resulting elastic nonwoven fabric. When the polar-solvent-insoluble particles are $3.00\times10^6$ or less per g of TPU, the TPU having the aforesaid starting temperature for solidifying can prevent problems such as wide distribution of fiber diameter and filament breakage during the spinning. When such TPU has been spun, the fiber will have diameter equivalent to that of ordinary fabrics so that the resultant nonwoven fabric will have a superior touch, being suitable for hygiene materials and like items. Moreover, the TPU containing the polar-solvent-insoluble particles in the suitable number is difficult to clog a filter for impurities fitted in an extruder. This requires less frequent adjustment and maintenance of the apparatus, and is industrially preferred.

The TPU containing lesser polar-solvent-insolubles can be prepared by filtration of a crude TPU given after polymerization of a polyol, an isocyanate compound and a chain extender.

With respect to the TPU, a total heat of fusion (a) determined from endothermic peaks within the temperature range of from 90 to 140° C. and a total heat of fusion (b) determined from endothermic peaks within the temperature range of from above 140 to 220° C., which are measured on a differential scanning calorimeter (DSC), preferably satisfy the relation (1):

$$a/(a+b)\times 100 \leqq 80 \quad (1);$$

more preferably satisfy the relation (2):

$$a/(a+b)\times 100 \leqq 70 \quad (2);$$

and optimally satisfy the relation (3):

$$a/(a+b)\times 100 \leqq 55 \quad (3)$$

wherein the left hand side "a/(a+b)×100" represents a ratio (%) of the heat of fusion attributed to the hard domains in the TPU.

When the above relational formula gives 80 or less, fibers, particularly spunbonded fibers, and nonwoven fabrics have improved strength and higher elasticity. In the invention, the lower limit on this ratio of the heat of fusion attributed to the hard domains in the TPU is suitably around 0.1.

The TPU preferably ranges in melt viscosity from 100 to 3000 Pa·s, more preferably from 200 to 2000 Pa·s, and optimally from 1000 to 1500 Pa·s as measured at 200° C. and 100 $sec^{-1}$ shear rate. The melt viscosity is a value determined by the use of a Capirograph (Toyo Seiki K.K., nozzle length: 30 mm, nozzle diameter: 1 mm).

The TPU preferably has a water content of 350 ppm or less, more preferably 300 ppm or less, and optimally 150 ppm or less. The TPU having a water content of 350 ppm or less can inhibits bubbles from being mixed into the strands and the filaments from breaking in the production of nonwoven fabrics with a large spunbonding machine.

<Production Method for Thermoplastic Polyurethane Elastomer>

As described hereinabove, the thermoplastic polyurethane elastomer may be produced from a polyol, an isocyanate compound and a chain extender that have optimal chemical structures. Exemplary processes for the production of the TPU include:

(i) a "prepolymer process" in which a polyol and an isocyanate compound are preliminarily reacted to give an isocyanato-terminated prepolymer (hereinafter "prepolymer") and the prepolymer is reacted with a chain extender; and (ii) a "one-shot process" in which a polyol and a chain extender are previously mixed and the mixture is reacted with an isocyanate compound.

Of these two, the prepolymer process is more preferable in view of mechanical characteristics and quality of the resultant TPU.

In the prepolymer process, the polyol and the isocyanate compound are mixed by stirring in the presence of an inert gas at around 40 to 250° C. for approximately 30 seconds to 8 hours to give a prepolymer; then the prepolymer is sufficiently mixed by high speed agitation with the chain extender in proportions such that the isocyanate index will be preferably 0.9 to 1.2, more preferably 0.95 to 1.15, and still preferably 0.97 to 1.08. Polymerization may be made at appropriate temperatures depending on the melting point of the chain extender and the viscosity of the prepolymer. For example, the polymerization temperature will be in the range of around 80 to 300° C., preferably 80 to 260° C., and optimally 90 to 220° C. The polymerization time will preferably range from about 2 seconds to 1 hour.

In the one-shot process, the polyol and the chain extender are mixed together and then degassed; thereafter the mixture is polymerized with the isocyanate compound by being stirred together at 40 to 280° C., preferably 100 to 260° C., for approximately 30 seconds to 1 hour. The isocyanate index in the one-shot process is preferably in the same range as in the prepolymer process.

<TPU Production Equipment>

The TPU may be continuously produced by reaction extrusion in a equipment comprised of a material storage tanks section, a mixer section, a static mixers section and a pelletizer section.

The material storage tanks section includes an isocyanate compound storage tank, a polyol storage tank, and a chain extender storage tank. Each storage tank is connected to a high-speed stirrer or a static mixers section (mentioned later) through a supply line having a gear pump and a downstream flow meter.

The mixer section has a mixing means such as a high-speed stirrer. The high-speed stirrer is not particularly limited if it is capable of high-speed mixing the aforesaid materials. Preferably, when the high-speed stirrer tank is equipped with a blade 4 cm in diameter and 12 cm around, it is capable of 300 to 5000 rpm (circumferential speed: 100 to 600 m/min), and desirably 1000 to 3500 rpm (circumferential speed: 120 to 420 m/min). The high-speed stirrer is preferably equipped with a heater (or a jacket) and a temperature sensor in order to detect changes in temperature in the stirring tank by means of the temperature sensor and accordingly condition the temperature by the heater.

The mixer section may optionally include a reaction pot, where the mixture of materials resulting from the high-speed stirring is temporarily kept to promote prepolymerization. The reaction pot preferably has a temperature control means. The reaction pot is preferably provided between the high-speed stirrer and a first static mixer in the most upstream position in the static mixers section.

The static mixers section preferably consists of plural static mixers connected in series. The static mixers (designated as the first static mixer 1, the second static mixer 2, the third static mixer 3, etc. from the upstream in the traveling direction for the materials) may have mixing elements of various figurations without limitation. For example, "Kagaku Kogaku no Shimpo (Advance of Chemical Engineering)" Vol. 24, Stirring and Mixing (edited by The Society of Chemical Engineers, Japan, Tokai Branch, and published from Maki Shoten on Oct. 20, 1990, first edition), in FIG. 10.1.1 on Page 155, illustrates Company-N type, Company-T type, Company-S type and Company-T type figurations. The static mixer having right element and left element arranged alternately is preferable. Optionally, the neighboring static mixers are connected by a straight pipe.

Each static mixer will range in length from 0.13 to 3.6 m, preferably 0.3 to 2.0 m, and more preferably 0.5 to 1.0 m, and have an inner diameter of 10 to 300 mm, preferably 13 to 150 mm, and more preferably 15 to 50 mm. The ratio of length to inner diameter (L/D) will range from 3 to 25, and preferably from 5 to 15. Each static mixer is preferably made of a substantially non-metallic material, such as fiber-reinforced plastic (FRP), in at least the liquid contact part thereof. Also preferably, each static mixer is coated with a fluorine-based resin, such as polytetrafluoroethylene, in at least the liquid contact part thereof. When the static mixers have the substantially non-metallic liquid contact parts, the polar-solvent insolubles are effectively prevented from occurring in the TPU. Exemplary static mixers include metallic static mixers whose inner walls are protected with fluorine-based resin tubes such as polytetrafluoroethylene tubes, and MX series commercially available from Noritake Company, Ltd.

Each static mixer is preferably equipped with a heater (or a jacket) and a temperature sensor in order to detect changes in temperature in the mixer by means of the temperature sensor and accordingly condition the temperature by the heater. This structure enables temperature control for individual static mixers depending on the composition of the materials. Accordingly, in the reduced catalyst amount, the TPU can be produced under optimum reaction conditions.

The first static mixer 1 in the most upstream position in the static mixers section is connected to the high-speed stirrer or the reaction pot of the mixer section. And the most downstream static mixer in the static mixers section is connected to a strand die of the pelletizer section or a single-screw extruder. The static mixers may be connected together in an arbitrary number depending on a desired mixing effect to meet the objective use of the TPU and the composition of the materials. For example, the static mixers may be serially connected 3 to 25 m long, and preferably 5 to 20 m long, or in 10 to 50 units, and preferably 15 to 35 units. Gear pumps may be optionally provided between the static mixers to control the flow rate.

The pelletizer section may be constituted with a known pelletizer such as an underwater pelletizer, or with a strand die and a cutter.

A single-screw extruder may be optionally arranged between the static mixers section and the pelletizer section in order to further knead the reaction product discharged from the static mixers section.

<TPU Production Method>

The TPU may be produced using an equipment as described above. For example, a mixture containing at least the isocyanate compound and the polyol is forced through the static mixers together with the chain extender, and these materials are polymerized as they mix together. Particularly preferably, polymerization will be made by a series of steps in which the isocyanate compound and the polyol are sufficiently mixed together in a high-speed stirrer and then further mixed with the chain extender by a high-speed stirrer, and these materials are reacted with each other while traveling through the static mixtures. Also preferably, the isocyanate compound and the polyol are first reacted to prepare a prepolymer, then the prepolymer is mixed with the chain extender in a high-speed stirrer, and the mixture is reacted in the static mixers.

The isocyanate compound and the polyol will be mixed together in a high-speed stirring tank at a residence time of 0.05 to 0.5 minute, preferably 0.1 to 0.4 minute, and at 60 to 150° C., preferably 80 to 140° C. When the mixture of the isocyanate compound and the polyol is kept in the reaction pot to promote prepolymerization, the residence time will be 0.1 to 60 minutes, and preferably 1 to 30 minutes, and the temperature will range from 80 to 150° C., and preferably from 90 to 140° C.

In either case, the mixture of the isocyanate compound and the polyol is fed together with the chain extender into the static mixtures to be polymerized. They may be fed to the static mixtures individually or after mixed together in a high-speed stirrer. As described earlier, the isocyanate compound and the polyol may be preliminarily reacted to give a prepolymer, and the prepolymer and the chain extender may be introduced into the static mixers with polymerization. The static mixers will have inside temperatures of 100 to 300° C., and preferably 150 to 280° C. The feed rate for the materials or the reaction product will be desirably set at 10 to 200 kg/h, and preferably 30 to 150 kg/h.

There are other processes useful to produce the TPU according to the invention. For example, the isocyanate compound, the polyol and the chain extender may be sufficiently mixed in a high-speed stirrer, and the mixture is continuously discharged on a belt and thereafter heated to induce polymerization.

These production processes afford the TPU containing lesser amount of the polar-solvent insolubles such as fish eye. The polar-solvent insolubles may be reduced by filtering the TPU. For example, the sufficiently dried TPU in pellet form may be extruded through an outlet head fitted with a filtering medium such as a metal mesh, a metallic nonwoven fabric or a polymer filter, thus filtering out the insolubles. The filtration can reduce the polar-solvent-insoluble particles to about $3\times10^4$ particles per g of TPU (lower limit). The extruder is preferably a single-screw extruder or a multi-screw extruder. The metal mesh usually has 100 meshes or above, preferably 500 meshes or above, and more preferably 1-000 meshes or above. A plural metal meshes which have the same or different mesh size each other are preferably used in piles. The polymer filters include Fuji Duplex Polymer Filter System (FUJI FILTERMGF. CO., LTD.), ASKA Polymer Filter System (ASKA Corporation) and DENA FILTER(NAGASE & CO. LTD.).

The TPU resulting from the above method may be crushed or finely divided by means of a cutter or a pelletizer, and then may be fabricated into desired shapes with an extruder or an injection molding machine.

<Polyol>

The polyol used in the production of the TPU is a polymer having two or more hydroxyl groups in the molecule. Examples thereof include polyoxyalkylene polyols, polytetramethylene ether glycols, polyester polyols, polycaprolactone polyols and polycarbonate diols. These may be used singly or in combination of two or more kinds. Polyoxyalkylene polyols, polytetramethylene ether glycols and polyester polyols are preferable.

The polyols are preferably dehydrated by being heated under reduced pressure until the water content lowers to a sufficient level. The water content will be preferably reduced to 0.05 wt % or below, more preferably 0.03 wt % or below, and even more preferably 0.02 wt % or below.

(Polyoxyalkylene Polyols)

Exemplary polyoxyalkylene polyols include polyoxyalkylene glycols, which are addition polymerized one or more relatively low-molecular weight divalent alcohols with alkylene oxides such as propylene oxide, ethylene oxide, butylene oxide and styrene oxide. Preferred polymerization catalysts include an alkali metal compound, such as cesium hydroxide or rubidium hydroxide, or a P═N having compound.

Of the aforesaid alkylene oxides, propylene oxide and ethylene oxide are particularly preferred. When two or more alkylene oxides are used, the propylene oxide will preferably account for at least 40 wt %, and more preferably at least 50 wt % of the total amount of alkylene oxides. When the alkylene oxides contain the propylene oxide in the above amount, the polyoxyalkylene polyol can contain oxypropylene groups in an amount of 40 wt % or more.

In order to attain higher durability and mechanical properties of the TPU, the polyoxyalkylene polyol will be preferably treated to convert at least 50 mol %, and more preferably at least 60 mol % of its molecular terminals to primary hydroxyl groups. Copolymerization with ethylene oxide at molecular terminals is a suitable way to achieve a desired level of conversion to the primary hydroxyl groups.

The polyoxyalkylene polyol used in the TPU production preferably ranges in number-average molecular weight from 200 to 8000, and more preferably from 500 to 5000. From the viewpoints of lowering the glass transition temperature and improving the fluidity of the TPU, two or more polyoxyalkylene polyols with different molecular weights and oxyalkylene group contents will be preferably used as a mixture in the production of the TPU. Moreover, the polyoxyalkylene polyol preferably contains a lesser amount of terminally unsaturated monols, the byproducts from addition polymerization with propylene oxide. The monol content in the polyoxyalkylene polyol is expressed as a degree of unsaturation as described in JIS K-1557. The polyoxyalkylene polyol preferably has an unsaturation degree of 0.03 meq/g or below, and more preferably 0.02 meq/g or below. When the unsaturation degree exceeds 0.03 meq/g, the TPU tends to have poorer heat resistance and durability. The lower limit on the unsaturation degree will be suitably around 0.001 meq/g in consideration of the industrial production of polyoxyalkylene polyol.

(Polytetramethylene Ether Glycols)

The polyol may be polytetramethylene ether glycol (hereinafter "PTMEG") resulting from ring opening polymerization of tetrahydrofuran. PTMEG preferably has a number-average molecular weight of about 250 to 4000, and particularly preferably about 250 to 3000.

(Polyester Polyols)

Exemplary polyester polyols include polymers resulted from condensation between one or more low-molecular weight polyols and one or more carboxylic acids selected from low-molecular weight dicarboxylic acids and oligomer acids.

The low-molecular weight polyols include ethylene glycol, diethylene glycol, propylene glycol, dipropylene glycol, 1,3-propanediol, 1,4-butanediol, 1,5-pentanediol, 1,6-hexanediol, glycerol, trimethylolpropane, 3-methyl-1,5-pentanediol, hydrogenated bisphenol A and hydrogenated bisphenol F. The low-molecular weight dicarboxylic acids include glutaric acid, adipic acid, sebacic acid, terephthalic acid, isophthalic acid and dimer acid. Specific examples of the polyester polyols include polyethylene butylene adipate polyol, polyethylene adipate polyol, polyethylene propylene adipate polyol and polypropylene adipate polyol.

The polyester polyols preferably range in number-average molecular weight approximately from 500 to 4000, and particularly preferably from 800 to 3000.

(Polycaprolactone Polyols)

The polycaprolactone polyols may be obtained by ring opening polymerization of ε-caprolactones.

(Polycarbonate Diols)

Exemplary polycarbonate diols include products obtained by condensation between divalent alcohols such as 1,4-butanediol and 1,6-hexanediol, and carbonate compounds such as dimethyl carbonate, diethyl carbonate and diphenyl carbonate. The polycarbonate diols preferably have number-average molecular weights ranging approximately from 500 to 3000, and particularly preferably from 800 to 2000.

<Isocyanate Compound>

The isocyanate compound used in the TPU production may be an aromatic, aliphatic or alicyclic compound having two or more isocyanato groups in the molecule.

(Aromatic Polyisocyanates)

Exemplary aromatic polyisocyanates include 2,4-tolylene diisocyanate, 2,6-tolylene diisocyanate, isomeric mixtures of tolylene diisocyanates with 2,4-isomer: 2,6-isomer weight ratio of 80:20 (TDI-80/20) or 65:35 (TDI-65/35); 4,4'-diphenylmethane diisocyanate, 2,4'-diphenylmethane diisocyanate, 2,2'-diphenylmethane diisocyanate and isomeric mixtures of arbitrary isomers of these diphenylmethane diisocyanates; toluoylene diisocyanate, xylylene diisocyanate, tetramethylxylylene diisocyanate, p-phenylene diisocyanate and naphthalene diisocyanate.

(Aliphatic Polyisocyanates)

Exemplary aliphatic polyisocyanates include ethylene diisocyanate, trimethylene diisocyanate, tetramethylene diisocyanate, hexamethylene diisocyanate, octamethylene diisocyanate, nonamethylene diisocyanate, 2,2'-dimethylpentane diisocyanate, 2,2,4-trimethylhexane diisocyanate, decamethylene diisocyanate, butene diisocyanate, 1,3-butadiene-1,4-diisocyanate, 2,4,4-trimethylhexamethylene diisocyanate, 1,6,11-undecamethylene triisocyanate, 1,3,6-hexamethylene triisocyanate, 1,8-diisocyanato-4-isocyanatomethyloctane, 2,5,7-trimethyl-1,8-diisocyanato-5-isocyanatomethyloctane, bis(isocyanatoethyl)carbonate, bis(isocyanatoethyl)ether, 1,4-butyleneglycol dipropylether-ω,ω'-diisocyanate, lysin isocyanatomethyl ester, lysin triisocyanate, 2-isocyanatoethyl-2,6-diisocyanatohexanoate, 2-isocyanatopropyl-2,6-diisocyanatohexanoate and bis(4-isocyanato-n-butylidene)pentaerythritol.

(Alicyclic Polyisocyanates)

Exemplary alicyclic polyisocyanates include isophorone diisocyanate, bis(isocyanatomethyl)cyclohexane, dicyclohexylmethane diisocyanate, cyclohexane diisocyanate, methylcyclohexane diisocyanate, 2,2'-dimethyldicyclohexylmethane diisocyanate, dimer acid diisocyanate, 2,5-diisocyanatomethyl-bicyclo[2.2.1]-heptane, 2,6-diisocyanatomethyl-bicyclo[2.2.1]-heptane, 2-isocyanatomethyl-2-(3-isocyanatopropyl)-5-isocyanatomethyl-bicyclo[2.2.1]-heptane, 2-isocyanatomethyl-2-(3-isocyanatopropyl)-6-isocyanatomethyl-bicyclo[2.2.1]-heptane, 2-isocyanatomethyl-3-(3-isocyanatopropyl)-5-(2-isocyanatoethyl)-bicyclo[2.2.1]-heptane, 2-isocyanatomethyl-3-(3-isocyanatopropyl)-6-(2-isocyanatoethyl)-bicyclo[2.2.1]-heptane, 2-isocyanatomethyl-2-(3-isocyanatopropyl)-5-(2-isocyanatoethyl)-bicyclo[2.2.1]-heptane and 2-isocyanatomethyl-2-(3-isocyanatopropyl)-6-(2-isocyanatoethyl)-bicyclo[2.2.1]-heptane.

These polyisocyanates may be used in modified forms with urethanes, carbodiimides, urethoimines, biurets, allophanates or isocyanurates.

Preferable polyisocyanates include 4,4'-diphenylmethane diisocyanate (MDI), hydrogenated MDI (dicyclohexylmethane diisocyanate (HMDI)), p-phenylene diisocyanate (PPDI), naphthalene diisocyanate (NDI), hexamethylene diisocyanate (HDI), isophorone diisocyanate (IPDI), 2,5-diisocyanatomethyl-bicyclo[2.2.1]-heptane (2,5-NBDI) and 2,6-diisocyanatomethyl-bicyclo[2.2.1]-heptane (2,6-NBDI). Of these, MDI, HDI, HMDI, PPDI, 2,5-NBDI and 2,6-NBDI are preferably used. These diisocyanates also be preferably used in modified forms with urethanes, carbodiimides, urethoimines or isocyanurates.

<Chain Extender>

The chain extender used in the TPU production is preferably an aliphatic, aromatic, heterocyclic or alicyclic, low-molecular weight polyol having two or more hydroxyl groups in the molecule. The chain extender is preferably dehydrated by being heated under reduced pressure until its water content lowers to a sufficient level. The water content will be preferably reduced to 0.05 wt % or below, more preferably 0.03 wt % or below, and even more preferably 0.02 wt % or below.

The aliphatic polyols include ethylene glycol, propylene glycol, 1,3-propanediol, 1,4-butanediol, 1,5-pentanediol, 1,6-hexanediol, glycerol and trimethylolpropane. The aromatic, heterocyclic or alicyclic polyols include p-xylene glycol, bis(2-hydroxyethyl) terephthalate, bis(2-hydroxyethyl) isophthalate, 1,4-bis(2-hydroxyethoxy) benzene, 1,3-bis(2-hydroxyethoxy) benzene, resorcin, hydroquinone, 2,2'-bis(4-hydroxycyclohexyl) propane, 3,9-bis(1,1-dimethyl-2-hydroxyethyl)-2,4,8,10-tetraoxaspiro[5.5]undecane, 1,4-cyclohexanedimethanol and 1,4-cyclohexanediol.

The chain extenders may be used singly or in combination of two or more kinds.

<Catalyst>

The TPU may be produced under catalysis by a common catalyst, such as organometallic compounds, widely used in preparing polyurethanes. Suitable catalysts include organometallic compounds such as tin acetate, tin octylate, tin oleate, tin laurate, dibutyltin diacetate, dibutyltin dilaurate, dibutyltin dichloride, zinc octanoate, zinc naphthenate, nickel naphthenate and cobalt naphthenate. These catalysts may be used singly or in combination or two or more kinds. The catalyst(s) will be used in an amount of 0.0001 to 2.0 parts by weight, and preferably 0.001 to 1.0 part by weight, based on 100 parts by weight of the polyol.

<Additives>

The TPU is preferably incorporated with an additive such as a heat stabilizer or a light stabilizer. The additives may be added either during or after the production of the TPU, but preferably they are preliminary dissolved within the reaction materials during the production of the TPU.

The heat stabilizers include hindered phenolic antioxidants, and phosphorous-, lactone- or sulfur-based heat stabilizers. Specific examples are IRGANOX series 1010, 1035, 1076, 1098, 1135, 1222, 1425WL, 1520L, 245, 3790, 5057, IRGAFOS series 168, 126, and HP-136 (all available from Ciba Specialty Chemicals).

The light stabilizers include benzotriazole-, triadine- or benzophenone-based ultraviolet light absorbers, benzoate-based light stabilizers and hindered amine-based light stabilizers. Specific examples are TINUVIN P, TINUVIN series 234, 326, 327, 328, 329, 571, 144, 765 and B75 (all available from Ciba Specialty Chemicals).

The heat stabilizers and the light stabilizers each are preferably used in an amount of 0.01 to 1 wt %, and more preferably 0.1 to 0.8 wt % of TPU.

The TPU may be optionally incorporated with further additives, including hydrolysis inhibitors, releasing agents, colorants, lubricants, rust preventives and fillers.

<Polymer>

The polymer for forming the elastic nonwoven fabric of the present invention may consist solely of the aforesaid thermoplastic polyurethane elastomer (TPU). The polymer may optionally contain other thermoplastic polymer(s) without adversely affecting the objects of the invention. When the polymer contains TPU and other thermoplastic polymer(s), TPU will preferably have an amount of 10 wt % or above, more preferably 50 wt % or above, still preferably 65 wt % or above, and optimally 75 wt % or above. When the polymer contains 10 wt % or above of the TPU, the elastic nonwoven fabric obtained therefrom will have sufficient elasticity and low residual strain. For example, such elastic nonwoven fabrics may be suitably used in garments, hygiene materials and materials for sporting goods that are required to repeatedly exhibit stretching properties.

(Other Thermoplastic Polymers)

The other thermoplastic polymers are not particularly limited if they can form nonwoven fabrics. Examples thereof include styrene elastomers, polyolefin elastomers, vinyl chloride elastomers, polyesters, ester elastomers, polyamides, amide elastomers, polyolefins such as polyethylene, polypropylene and polystyrene, and polylactic acids.

The styrene elastomers include diblock and triblock copolymers based on a polystyrene block and either a butadiene rubber block or an isoprene rubber block. These rubber blocks may be unsaturated or completely hydrogenated. Specific examples of the styrene elastomers include elastomers commercially available under the trade names of KRATON polymers (Shell Chemicals), SEPTON (KURARAY CO., LTD.), TUFTEC (Asahi Kasei Corporation) and LEOSTOMER(RIKEN TECHNOS CO.).

The polyolefin elastomers include ethylene/α-olefin copolymers and propylene/α-olefin copolymers. Specific examples thereof include TAFMER (Mitsui Chemicals, Inc.), Engage (ethylene/octene copolymer, DuPont Dow Elastomers) and CATALLOY (crystalline olefin copolymer, MONTELL).

The vinyl chloride elastomers include LEONYL (RIKEN TECHNOS CO., LTD) and Posmere (Shin-Etsu Polymer Co.).

The ester elastomers include HYTREL (E.I. DuPont) and PELPRENE (TOYOBO CO., LTD.).

The amide elastomers include PEBAX (ATOFINA Japan Co., Ltd.).

Other exemplary thermoplastic polymers include DUMILAN (ethylene/vinyl acetate/vinyl alcohol copolymer, Mitsui Takeda Chemicals, Inc.), NUCREL (ethylene/(meth)acrylic acid copolymer resin, DUPONT-MITSUI POLYCHEMICALS CO., LTD.) and ELVALOY (ethylene/acrylic ester/carbon oxide terpolymer, DUPONT-MITSUI POLYCHEMICALS CO., LTD.).

These other thermoplastic polymers may be melt blended with TPU, then pelletized and thereafter spun. Alternatively, they may be pelletized, then blended with TPU pellets and spun together.

(Additives)

The polymer may contain additives, including various stabilizers such as heat stabilizers and weathering stabilizers, antistatic agents, slip agents, anti-fogging agents, lubricants, dyes, pigments, natural oils, synthetic oils and waxes.

Exemplary stabilizers include anti-aging agents such as 2,6-di-t-butyl-4-methylphenol (BHT); phenolic antioxidants such as tetrakis[methylene-3-(3,5-di-t-butyl-4-hydroxyphenyl)propionato]methane, β-(3,5-di-t-butyl-4-hydroxyphenyl) propionic acid alkyl ester, 2,2'-oxamidobis[ethyl-3-(3,5-di-t-butyl-4-hydroxyphenyl)] propionate and Irganox 1010 (trade name, hindered phenolic antioxidant); metal salts of fatty acids, such as zinc stearate, calcium stearate and calcium 1,2-hydroxystearate; and fatty acid esters of polyvalent alcohols, such as glycerin monostearate, glycerin distearate, pentaerythritol monostearate, pentaerythritol distearate and pentaerythritol tristearate. These stabilizers may be used singly or in combination of two or more kinds.

<Elastic Nonwoven Fabric>

The elastic nonwoven fabric of the invention is produced by spunbonding the TPU-containing polymer. The spunbonding may be a conventional technique. For example, the method disclosed in JP-A-60-155765 may be employed. A specific exemplary process will be given below. First, the polymer is melt spun through a spinneret into a plurality of fibers. When TPU and other thermoplastic polymer(s) are used in combination, they may be formed into conjugate fibers having a sheath-core configuration, a segmented configuration, an islands-in-the-sea configuration or a side-by-side configuration. As used herein, the "conjugate fiber" will refer to a fiber in which there are at least two phases that have a length/diameter ratio which is appropriate for the strand to be called as a fiber. Here, the diameter will be considered as of the cross section of fiber regarded as a circle. There are three types of sheath-core configurations:

a concentric configuration in which the circular core portion and the doughnut-shaped sheath portion are arranged in concentric relation;

an eccentric configuration in which the core portion is completely included within the sheath portion with their centers apart from one another; and an exposed core configuration in which the core portion is partially exposed from the sheath portion due to their centers being far apart from one another.

The extruded fibers are subsequently introduced in a cooling chamber, quenched with a cooling air, thereafter drawn by air, and deposited on a moving collecting surface. In the production process:

a die with the spinneret will generally have a temperature of 180 to 240° C., preferably 190 to 230° C., and more preferably 200 to 225° C.;

the cooling air temperature will generally range from 5 to 50° C., preferably from 10 to 40° C., and more preferably from 15 to 30° C. from the viewpoints of economical efficiency and spinnability; and the drawing air will generally have a velocity of 100 to 10,000 m/min, and preferably 500 to 10,000 m/min.

The fibers formed as described above generally have diameters of 50 μm or less, preferably 40 μm or less, and more preferably 30 μm or less. The variation in diameter among these fibers is smaller than among melt blown fibers. The fiber diameters are such that the standard deviation thereof (Sn) divided by the average fiber diameter ($X_{ave}$) ($Sn/X_{ave}$) gives a value of 0.15 or less, preferably 0.12 or less, and more preferably 0.10 or less. The smaller the $Sn/X_{ave}$ value, the evener the nonwoven fabric surface, leading to remarkable improvement in touch.

Subsequently, after the fiber deposited on a moving collecting surface in a web form, the deposition is partially entangled or fusion bonded. The entangle treatment may be carried out by needle punching, water jetting or ultrasonic sealing, and the fusion bonding may be effected with a thermal embossing roll. Fusion bonding with a thermal embossing roll is preferably employed. The thermal embossing temperature is usually 50 to 160° C., and preferably 70 to 150° C. The thermal embossing roll may have an arbitrary embossing area percentage, which although is preferably between 5 and 30%.

The heat embossing as described above enables highly improved properties, including tensile strength, maximum strength and elongation at break, since the mechanical bonding achieves firmer adhesion among fibers than does melt-blowing where fibers were fusion bonded automatically by their heat. Also, embossed areas are very resistant to fracture upon elongation so that the residual strain can be reduced.

Such nonwoven fabrics have excellent elasticity and are favorably used in materials which bring into contact with a skin, such as garments, hygiene materials and materials for sporting goods. The hygiene materials include disposable diapers, sanitary napkins and urine absorbent pads.

The elastic nonwoven fabric has a tensile strength per basis weight at 100% elongation of 1 to 50 gf/basis weight, preferably 1.5 to 30 gf/basis weight, and more preferably 2 to 20 gf/basis weight. When the tensile strength is 1 gf/basis weight or above, the elastic nonwoven fabric can exert good body conformability when used in garments, hygiene materials and materials for sporting goods.

The elastic nonwoven fabric ranges in maximum strength per basis weight from 5 to 100 gf/basis weight, preferably from 10 to 70 gf/basis weight, and more preferably from 15 to 50 gf/basis weight. Having the maximum strength of 5 gf/basis weight or above, the elastic nonwoven fabric will be more resistant to breakage when used in garments, hygiene materials and materials for sporting goods.

The elastic nonwoven fabric has a maximum elongation of 50 to 1200%, preferably 100 to 1000%, and more preferably 150 to 700%. When the maximum elongation is 50% or more, the elastic nonwoven fabric provides comfortable fit when used in garments, hygiene materials and materials for sporting goods.

The elastic nonwoven fabric has a residual strain of 50% or less, preferably 35% or less, and more preferably 30% or less after 100% elongation. The residual strain of 50% or less can make less noticeable the deformation of nonwoven fabric products such as garments, hygiene materials and materials for sporting goods.

The elastic nonwoven fabric ranges in basis weight from 3 to 200 g/cm$^2$, and preferably from 5 to 150 g/cm$^2$.

Laminate

The elastic nonwoven fabric of the invention may be bonded with an extensible nonwoven fabric to form an elastic laminate having softer touch.

The extensible nonwoven fabric is not particularly limited if it can be stretched to the elastic limit of the elastic nonwoven fabric according to the invention. When the laminate is intended for hygiene materials such as disposable diapers, the extensible nonwoven fabric is preferably made up of a polymer containing polyolefin, particularly polyethylene and/or polypropylene, from the viewpoints of superior touch, high elasticity and excellent heat sealing properties. When the thermal embossing is employed in the production of the laminate, the extensible nonwoven fabric is preferably comprised of a polymer that has good compatibility and bondability with the elastic nonwoven fabric according to the invention.

The fibers constituting the extensible nonwoven fabric preferably have a monocomponent configuration, a sheath-core configuration, a segmented configuration, an islands-in-the-sea configuration or a side-by-side configuration. The extensible nonwoven fabric comprises a mixture of fibers having the different configurations.

The elastic laminate may be produced by a series of steps in which:

the elastic fibers according to the invention are deposited on a collecting surface by the procedure described hereinabove;

extensible fibers are deposited on the elastic fiber web; and the elastic fibers and the extensible fibers are entangled or fusion bonded with each other by any method described above to form a laminate comprising the elastic nonwoven fabric layer and the extensible nonwoven fabric layer. The laminate may also be formed by bonding the elastic nonwoven fabric and the extensible nonwoven fabric by means of an adhesive.

When thermal embossing is employed in the production of the laminate, it is preferably carried out under similar conditions to those described above for the elastic nonwoven fabric. Suitable adhesives include resin adhesives such as vinyl acetate adhesives, vinyl chloride adhesives and polyvinyl alcohol adhesives, and rubber adhesives such as styrene/butadiene adhesives, styrene/isoprene adhesives and urethane adhesives. Solution adhesives in organic solvents and aqueous emulsion adhesives of these adhesives may also be used. Of the adhesives, hot-melt rubber adhesives such as styrene/isoprene adhesives and styrene/butadiene adhesives may be favorably used because of the resultant effect while maintaining soft touch of the laminate.

A laminate of the invention may be produced by laminating a thermoplastic polymer film on the layer comprising the elastic nonwoven fabric. The thermoplastic polymer film may be breathable or perforated film.

EXAMPLES

The present invention will be described by the following Examples, but it should be construed that the invention is in no way limited thereto. In Examples and Comparative Examples, TPUs were analyzed and tested to determine their properties by the procedures illustrated hereinbelow.

(1) Starting Temperature for Solidifying

The starting temperature for solidifying was obtained on a differential scanning calorimeter (DSC 220C) connected to a Disc Station Model SSC 5200H (Seiko Instruments Inc.). Approximately 8 mg of the sample, ground TPU, was weighed on an aluminum pan, which was then capped and crimped. A reference was prepared in the same manner using alumina. After the sample and the reference were put in place in the cell, an experiment was carried out in a nitrogen stream fed at a flow rate of 40 Nml/min. The temperature was raised from room temperature to 230° C. at a rate of 10° C./min, maintained at the temperature for 5 minutes, and lowered to −75° C. at a rate of 10° C./min. From the exothermic profile recorded in this experiment, the starting point (initial rise temperature) of the exothermic peak attributed to the solidification of TPU was obtained as the starting temperature for solidifying (C.°).

(2) Number of Polar-Solvent-Insoluble Particles

Polar-solvent-insoluble particles were counted on a particle size distribution analyzer Multisizer II (Beckman Coulter, Inc.) based on an electrical sensing zone method. A 5-L separable flask was charged with 3500 g of dimethylacetamide (Wako Special Grade, available from Wako Pure Chemical Industries, Ltd.) and 145.83 g of ammonium thiocyanate (special grade, available from JUNSEI CHEMICAL CO., LTD.). They were brought to a solution at room temperature over a period of 24 hours. The solution was filtered through a 1 μm-membrane filter under reduced pressure. A reagent A was thus obtained. Thereafter, 180 g of the reagent A and 2.37 g of TPU pellets were precisely weighed into a 200 cc glass bottle. Soluble components of TPU were allowed to dissolve over a period of 3 hours. The solution thus obtained was used as a sample. A 100 μm-aperture tube was attached to the Multisizer II, and the existing solvent in the analyzer was replaced with the reagent A. The pressure was reduced to nearly 3000 mmAq. Thereafter, the reagent A was weighed in an amount of 120 g into a beaker which had been sufficiently washed. Blank measurement was carried out to provide that pulses appeared at a rate of 50 or less per minute. After the optimum current and gain had been set manually, calibration was made using 10 μm standard particles of uncrosslinked polystyrene. To carry out the measurement, a sufficiently washed beaker was charged with 120 g of the reagent A and about 10 g of the sample. The measurement was conducted for 210 seconds. The number of particles counted during this measurement was divided by the amount of TPU aspirated into the aperture tube to determine the number of polar-solvent-insoluble particles in the TPU (particles/g). The amount of TPU is calculated by the following formula:

$$\text{TPU amount}=\{(A/100)\times B/(B+C)\}\times D$$

wherein A is a TPU concentration in the sample (wt %), B is an amount of the sample weighted into the beaker, C is an amount of the reagent A weighted into the beaker, and D is an amount of the solution aspirated into the aperture tube during the measurement (for 210 seconds).

(3) Ratio of Heat of Fusion Attributed to Hard Domains

The ratio of the heat of fusion attributed to the hard domains was obtained on a differential scanning calorimeter (DSC 220C) connected to a Disc Station Model SSC 5200H (Seiko Instruments Inc.). Approximately 8 mg of the sample, ground TPU, was placed on an aluminum pan, which was then capped and crimped. A reference was prepared in the same manner using alumina. After the sample and the reference were put in place in the cell, an experiment was carried out in a nitrogen stream fed at a flow rate of 40 Nml/min. The temperature was raised from room temperature to 230° C. at a rate of 10° C./min. From the endothermic profile recorded in this experiment, the total heat of fusion (a) determined from endothermic peaks within the temperature range of from 90 to 140° C. and the total heat of fusion (b) determined from endothermic peaks within the temperature range of from above 140 to 220° C. were obtained. These values were substituted to the following equation to determine the ratio of the heat of fusion attributed to the hard domains:

$$\text{Heat of fusion}(\%)=a/(a+b)\times 100$$

(4) Melt Viscosity at 200° C.

The melt viscosity (Pa·s) at 200° C. (hereinafter "melt viscosity") was determined for TPU at a shear rate of 100 $sec^{-1}$ on a Capirograph Model 1C (Toyo Seiki K.K.) having a nozzle 30 mm in length and 1 mm in diameter.

(5) The Water Content in TPU

The water content (ppm) in TPU was measured on a water content measurement device Model AVQ-5S and an evaporator Model EV-6 (both available from HIRANUMA SANGYO Co., Ltd.). Approximately 2 g of TPU pellets were weighed on a pan and introduced into a 250° C. hot oven. The evaporated water was led to a water-free titration cell of the water content measurement device and titration was performed using a Karl Fischer reagent. When the voltage between the electrodes remained unchanged for 20 seconds, it was considered that the water content in the cell had ceased to increase so that the titration was terminated.

(6) Hardness (Shore A)

TPU was tested in accordance with JIS K-7311 at 23° C. and 50% RH to determine the hardness. A durometer Type A was used in the test.

(7) Average Smallest Fiber Diameter

Melt spinning was performed under the same conditions as in the production of a nonwoven fabric except for a drawing rate. In the spinning, the drawing rate for the filaments was stepwise increased by 250 m/min until filament breakage took place and lowered therefrom by 250 m/min. At the drawing rate determined as described above, the fibers were drawn under the same conditions as in the production of a nonwoven fabric except for a drawing rate. The drawn fibers were deposited to form a web. This web was defined as a web having smallest fiber diameters. The image of web having smallest fiber diameters was taken at 200-hold magnification, and was analyzed on a dimension measuring software Pixs 2000 Ver 2.0 (Inotech). Diameters were measured for arbitrary 100 fibers and averaged to determine the average smallest fiber diameter (μm) of the fibers.

(8) Average Fiber Diameter and Standard Deviation

The image of a nonwoven fabric in the Examples was taken at 200-hold magnification by an electron microscope. In Comparative Examples, the image of broken or fusion bonded fibers in a nonwoven fabric was taken at 200-hold magnification by an electron microscope. The diameters of arbitral 100 fibers (Xi, unit: μm) in these images were measured. The results were averaged to determine the average fiber diameter ($X_{ave}$, unit: μm). The standard deviation (Sn, unit: μm) was obtained from the following equation (n=100).

$$Sn = \sqrt{\frac{1}{n-1}\sum_{i=1}^{n}(Xi - X_{ave})^2}$$

(9) Occurrence of Filament Breakage

Spinning was visually observed from the vicinity of the spinneret to count the occurrence of filament breakage for 5 minutes (times/5 min). The "filament breakage" was counted when single filament broke during the spinning, and was disregarded when adhered filaments broke (which was separately counted as fusion bonded fibers).

(10) Occurrence of Fusion Bonded Fibers

Spinning was visually observed from the vicinity of the spinneret to count the occurrence of fusion bonded fibers for 5 minutes (times/5 min).

(11) Maximum Strength and Maximum Elongation

Five specimens, each 5.0 cm in the machine direction (MD) and 2.5 cm in the cross direction (CD), were cut from a nonwoven fabric. They were each stretched at a gap between chucks of 30 mm and a rate of 30 mm/min to determine the elongation at the maximum load. The elongations at the maximum load of the 5 specimens were averaged to determine the maximum elongation (%). The average of the maximum load for the 5 specimens was divided by the basis weight to determine the maximum strength (gf/basis weight).

(12) Residual Strain and Tensile Strength

Five specimens, each 5.0 cm in the machine direction (MD) and 2.5 cm in the cross direction (CD), were cut from a nonwoven fabric. They were each stretched to 100% elongation at a gap between chucks of 30 mm and a rate of 30 mm/min, thereat measuring the load. Immediately thereafter, each specimen was relaxed to its original length at the same rate and the strain was measured at a tensile load of 0 gf. The loads at 100% elongation of the 5 specimens were averaged, and the average was divided by the basis weight to determine the tensile strength (gf/basis weight). The strains of the 5 specimens were averaged to determine the residual strain (%).

(13) Touch

The above spunbonded nonwoven fabric was evaluated for its touch by 10 panelists. The evaluation was made based on the following criteria:

A: 10 out of the 10 panelists said the fabric was nonsticky and nice to the touch.

B: 9 to 7 out of the 10 panelists said the fabric was nonsticky and nice to the touch.

C: 6 to 3 out of the 10 panelists said the fabric was nonsticky and nice to the touch.

D: 2 or 0 out of the 10 panelists said the fabric was nonsticky and nice to the touch.

<TPU Production Example 1>

In an atmosphere of nitrogen, 280.3 parts by weight of 4,4'-diphenylmethane diisocyanate (hereinafter "MDI") (trade name: Cosmonate PH, available from Mitsui Takeda Chemicals, Inc.) was placed in an isocyanate compound storage tank (hereinafter "tank A") and heated to 45° C. with agitation while avoiding bubbles.

Separately, a polyol storage tank (hereinafter "tank B") was charged under a nitrogen atmosphere with:

219.8 parts by weight of polyester polyol having a number-average molecular weight of 1000 (trade name: Takelac U2410, available from Mitsui Takeda Chemicals, Inc.);

439.7 parts by weight of polyester polyol having a number-average molecular weight of 2000 (trade name: Takelac U2420, available from Mitsui Takeda Chemicals, Inc.);

2.97 parts by weight of bis(2,6-diisopropyl phenyl) carbodiimide (trade name: Stabilizer 7000, available from RASCHIG GmbH);

2.22 parts by weight of a hindered phenolic antioxidant (trade name: Irganox 1010, available from Ciba Specialty Chemicals); and 2.22 parts by weight of a benzotriazole-based ultraviolet light absorber (trade name: JF-83, available from Johoku Chemical Co., Ltd).

The contents were brought to 90° C. under agitation. This mixture will be refereed to as the polyol solution 1.

Subsequently, 60.2 parts by weight of a chain extender, 1,4-butanediol (BASF JAPAN), was introduced into a chain extender storage tank (hereinafter "tank C") in an atmosphere of nitrogen and brought to 50° C.

These materials had amounts that would allow estimation of the hard segment amount to be 34 wt %.

Thereafter, MDI and the polyol solution 1 were supplied though liquid-supply lines with gear pumps and flow meters at constant flow rates of 16.69 kg/h and 39.72 kg/h respectively to a high-speed stirrer temperature-controlled at 120° C. (Model SM40 available from Sakura Plant). After they had been mixed by stirring at 2000 rpm for 2 min, the liquid mixture was supplied to a stirrer-equipped reaction pot temperature-controlled at 120° C. Subsequently, the liquid mixture and 1,4-butanediol were supplied from the reaction pot and the tank C at constant flow rates of 56.41 kg/h and 3.59 kg/h respectively to a high-speed stirrer (Model SM40) temperature-controlled at 120° C., and they were mixed by stirring at 2000 rpm for 2 min. The resultant mixture was passed though a series of static mixers whose insides had been coated with Teflon™ or protected with a Teflon™ tube. The static mixers section consisted of a series of 1st to 3rd static mixers whose each is 0.5 m in length and 20 mm in inner diameter (temperature: 250° C.), 4th to 6th static mixers whose each is 0.5 m in length and 20 mm in inner diameter (temperature: 220° C.), 7th to 12th static mixers whose each is 1.0 m in length and 34 mm in inner diameter (temperature: 210° C.), and 13th to 15th static mixers whose each is 0.5 m in length and 38 mm in inner diameter (temperature: 200° C.).

The reaction product discharged from the 15th static mixer was introduced via a gear pump into a single-screw extruder (65 mm in diameter, temperature controlled at 200 to 215° C.)

which was fitted at an outlet head with a polymer filter (DENA FILTER available from NAGASE & CO. LTD.), and forced through a strand die. The resultant strands were water-cooled and consecutively cut by a pelletizer. The pellets were maintained in a dryer at 85 to 90° C. over a period of 8 hours. Thus, a thermoplastic polyurethane elastomer (TPU-1) with a water content of 65 ppm resulted.

The tests provided that TPU-1 had a starting temperature for solidifying of 115.6° C. and contained $1.40\times10^6$ polar-solvent-insoluble particles per g. Separately, TPU-1 was injection molded into a specimen, which was found to have a hardness of 86 A. TPU-1 had a 200° C. melt viscosity of 2100 Pa·s and a ratio of the heat of fusion attributed to the hard domains of 62.8%.

<TPU Production Example 2>

In a nitrogen atmosphere, 288.66 parts by weight of MDI was introduced into the tank A and heated to 45° C. with agitation while avoiding bubbles.

Separately, the tank B was charged under a nitrogen atmosphere with:

216.2 parts by weight of polytetramethylene ether glycol having a number-average molecular weight of 1000 (trade name: PTG-1000, available from Hodogaya Chemicals);

432.5 parts by weight of polyester polyol having a number-average molecular weight of 2000 (trade name: Takelac U2720, available from Mitsui Takeda Chemicals, Inc.);

2.22 parts by weight of Irganox 1010; and 2.22 parts by weight of JF-83.

The contents were brought to 95° C. under agitation. This mixture will be refereed to as the polyol solution 2.

Subsequently, 62.7 parts by weight of a chain extender, 1,4-butanediol, was introduced into the tank C in an atmosphere of nitrogen and brought to 50° C.

These materials had amounts that would allow estimation of the hard segment amount to be 35 wt %.

Thereafter, MDI and the polyol solution 2 were supplied though liquid-supply lines with gear pumps and flow meters at constant flow rates of 17.24 kg/h and 39.01 kg/h respectively to a high-speed stirrer (Model SM40) temperature-controlled at 120° C. After they had been mixed by stirring at 2000 rpm for 2 min, the liquid mixture was supplied to a stirrer-equipped reaction pot temperature-controlled at 120° C. Subsequently, the liquid mixture and 1,4-butanediol were supplied from the reaction pot and the tank C at constant flow rates of 56.25 kg/h and 3.74 kg/h respectively to a high-speed stirrer (Model SM40) temperature-controlled at 120° C., and they were mixed by stirring at 2000 rpm for 2 min. The resultant mixture was passed though a series of the static mixers as described in Production Example 1.

The reaction product discharged from the 15th static mixer was pelletized in the same manner as in Production Example 1. The pellets were maintained in a dryer at 85 to 90° C. over a period of 8 hours. Thus, a thermoplastic polyurethane elastomer (TPU-2) with a water content of 70 ppm resulted.

The tests provided that TPU-2 had a starting temperature for solidifying of 106.8° C. and contained $1.50\times10^6$ polar-solvent-insoluble particles per g. Separately, TPU-2 was injection molded into a specimen, which was found to have a hardness of 85 A. TPU-2 had a 200° C. melt viscosity of 1350 Pa·s and a ratio of the heat of fusion attributed to the hard domains of 55.1%.

<TPU Production Example 3>

A pressure kneader purged with nitrogen was charged with:

100 parts by weight of adipate polyester polyol (trade name: Takelac U2410, available from Mitsui Takeda Chemicals, Inc.);

3.12 parts by weight of 1,4-butanediol;

0.13 part by weight of an amide wax lubricant (stearic acid amide); and 0.38 part by weight of a weathering stabilizer (trade name: Sanol LS-770, available from Sankyo Co., Ltd.).

After the contents had been heated to 60° C., 22.46 parts by weight of 1,6-hexamethylene diisocyanate (trade name: Takenate 700, available from Mitsui Takeda Chemicals, Inc.) was added with stirring, followed by stirring for 20 minutes. The resultant liquid mixture was poured into a stainless steel container and introduced into an oven temperature-controlled at 70° C.; the reaction was carried out in a nitrogen atmosphere at 70° C. for 24 hours to obtain TPU in a sheet form. The sheet was gradually cooled to room temperature and crushed into flakes by a granulator. The flakes were dried under reduced pressure to give a thermoplastic polyurethane elastomer (TPU-3) having a water content of 120 ppm.

The tests provided that TPU-3 had a starting temperature for solidifying of 55.2° C. and contained $3.50\times10^6$ polar-solvent-insoluble particles per g. Separately, TPU-3 was injection molded into a specimen, which was found to have a hardness of 86 A. TPU-3 had a fluidization initiation temperature of 108° C. according to the measurement described in WO99/39037 (Page 9, Lines 3-9).

<TPU Production Example 4>

In an atmosphere of nitrogen, MDI was placed in the tank A and heated to 45° C. with agitation while avoiding bubbles.

Separately, the tank B was charged under a nitrogen atmosphere with:

628.6 parts by weight of polyester polyol having a number-average molecular weight of 2000 (trade name: Takelac U2024, available from Mitsui Takeda Chemicals, Inc.);

2.21 parts by weight of Irganox 1010; and 77.5 parts by weight of 1,4-butanediol.

The contents were brought to 95° C. under agitation. This mixture will be refereed to as the polyol solution 3.

These materials had amounts that would allow estimation of the hard segment amount to be 37.1 wt %.

Thereafter, MDI and the polyol solution 3 were supplied though liquid-supply lines with gear pumps and flow meters at constant flow rates of 17.6 kg/h and 42.4 kg/h respectively to a high-speed stirrer (Model SM40) temperature-controlled at 120° C. After they had been mixed by stirring at 2000 rpm for 2 min, the liquid mixture was passed through a series of static mixers in the same manner as in Production Example 1. The static mixers section consisted of a series of 1st to 3rd static mixers whose each is 0.5 m in length and 20 mm in inner diameter (temperature: 230° C.), 4th to 6th static mixers whose each is 0.5 min length and 20 mm in inner diameter (temperature: 220° C.), 7th to 12th static mixers whose each is 1.0 m in length and 34 mm in inner diameter (temperature: 210° C.), and 13th to 15th static mixers whose each is 0.5 m in length and 38 mm in inner diameter (temperature: 200° C.).

The reaction product discharged from the 15th static mixer was introduced via a gear pump into a single-screw extruder (65 mm in diameter, temperature controlled at 180 to 210° C.) which was fitted at an outlet head with a polymer filter (DENA FILTER available from NAGASE & CO. LTD.) and forced through a strand die. The resultant strands were water-cooled and consecutively cut by a pelletizer. The pellets were maintained in a dryer at 100° C. over a period of 8 hours. Thus, a thermoplastic polyurethane elastomer with a water content of 40 ppm resulted. The thermoplastic polyurethane elastomer was then continuously extruded on a single-screw extruder (50 mm in diameter, temperature-controlled at 180 to 210° C.) and were pelletized. The pellets were maintained in a dryer at 100° C. over a period of 7 hours. Thus, a thermoplastic polyurethane elastomer (TPU-4) with a water content of 57 ppm resulted.

The tests provided that TPU-4 had a starting temperature for solidifying of 103.7° C. and contained $1.50\times10^6$ polar-solvent-insoluble particles per g. Separately, TPU-4 was injection molded into a specimen, which was found to have a hardness of 86 A. TPU-4 had a 200° C. melt viscosity of 1900 Pa·s and a ratio of the heat of fusion attributed to the hard domains of 35.2%.

Example 1

TPU-1 prepared in Production Example 1 was melt spun using a spunbond machine under the conditions of a die temperature of 220° C., an output of 1.0 g/min per nozzle, a cooling air temperature of 20° C., and a drawing air velocity of 3000 m/min. The spunbond machine used herein was equipped with a spinneret that had a nozzle diameter of 0.6 mm and nozzle pitches of 8 mm longitudinally and 8 mm transversely. The resultant fibers of TPU-1 were deposited on a collecting surface to form a web, and the web was embossed at 80° C. with an embossing roll (embossing area percentage: 7%, roll diameter: 15 mm, boss pitches: 2.1 mm transversely and longitudinally, boss shape: rhombus). Thus, a spunbonded nonwoven fabric with a basis weight of 100 g/m$^2$ was obtained. The spunbonded nonwoven fabric was evaluated by the aforementioned methods. The results are set forth in Table 1.

Example 2

A spunbonded nonwoven fabric was prepared and evaluated by the procedure illustrated in Example 1 except that TPU-1 was replaced by TPU-2. The results are set forth in Table 1.

Example 3

An ethylene/vinyl acetate/vinyl alcohol copolymer (trade name: Dumilan C1550, available from Mitsui Takeda Chemicals, Inc.) was dehydrated to a water content of 78 ppm by a drier at 70° C. over a period of 8 hours.

TPU-2 and the ethylene/vinyl acetate/vinyl alcohol copolymer were melt blended in amounts of 95 parts by weight and 5 parts by weight respectively and thereafter pelletized. The starting temperature for solidifying of the obtained polymer blend was 104.2° C. Separately, the polymer blend was injection molded into a specimen, which was found to have a hardness of 85 A.

A spunbonded nonwoven fabric was prepared and evaluated by the procedure illustrated in Example 1 except that TPU-1 was replaced by the polymer blend. The results are set forth in Table 1.

Example 4

A styrene/ethylene/propylene/styrene block copolymer (SEPS) (trade name: SEPTON 2002, available from KURARAY CO., LTD.) was dehydrated to a water content of 58 ppm by a drier at 80° C. over a period of 8 hours. Separately, an ethylene/α-olefin copolymer (trade name: TAFMER A-35050, available from Mitsui Chemicals, Inc.) was dehydrated to a water content of 50 ppm by a drier at 75° C. over a period of 8 hours.

TPU-2, SEPTON 2002 and the ethylene/α-olefin copolymer were melt blended in amounts of 80 parts by weight, 15 parts by weight and 5 parts by weight respectively and thereafter pelletized. The starting temperature for solidifying of the obtained polymer blend was 98.2° C. Separately, the polymer blend was injection molded into a specimen, which was found to have a hardness of 85 A.

A spunbonded nonwoven fabric was prepared and evaluated by the procedure illustrated in Example 1 except that TPU-1 was replaced by the polymer blend. The results are set forth in Table 1.

Example 5

A styrene/ethylene/propylene/styrene block copolymer (SEPS) (trade name: SEPTON 2004, available from KURARAY CO., LTD.) was dehydrated to a water content of 62 ppm by a drier at 80° C. over a period of 8 hours.

TPU-2 and SEPTON 2004 were melt blended in amounts of 45 parts by weight and 55 parts by weight respectively and thereafter pelletized. The starting temperature for solidifying of the obtained polymer blend was 90.7° C. Separately, the polymer blend was injection molded into a specimen, which was found to have a hardness of 82 A.

A spunbonded nonwoven fabric was prepared and evaluated by the procedure illustrated in Example 1 except that TPU-1 was replaced by the polymer blend. The results are set forth in Table 1.

Example 6

A spunbonded nonwoven fabric was prepared and evaluated by the procedure illustrated in Example 1 except that TPU-1 was replaced by TPU-4. The results are set forth in Table 1.

Example 7

A spunbonded nonwoven fabric was prepared and evaluated by the procedure illustrated in Example 6 except that the basis weight was changed from 100 g/m$^2$ to 40 g/m$^2$. The results are set forth in Table 1.

Example 8

A spunbonded nonwoven fabric was prepared and evaluated by the procedure illustrate in Example 1 except that TPU-4 and a propylene homopolymer (hereinafter "PP-1") that had MFR (ASTM D1238, 230° C., 2.16 kg load) of 60 g/10 min, a density of 0.91 g/cm$^3$ and a melting point of 160° C., were melt spun in 50/50 weight ratio by a spunbond machine equipped with a hollow, eight-segmented spinneret. The results are set forth in Table 1.

TABLE 1

| | Ex. 1 | Ex. 2 | Ex. 3 |
|---|---|---|---|
| Polymer (wt %) | TPU-1 (100) | TPU-2 (100) | TPU-2 (95)<br>C1550 (5) |
| Fiber configuration | Monocomponent fiber | Monocomponent fiber | Monocomponent fiber |
| Starting temperature for solidifying of TPU | 115.6° C. | 106.8° C. | 106.8° C. |
| Polar-solvent-insoluble particles in TPU | $1.40 \times 10^6$/g | $1.50 \times 10^6$/g | $1.50 \times 10^6$/g |
| Shore A hardness of TPU | 86 | 85 | 85 |
| Fiber forming method | Spunbonding | Spunbonding | Spunbonding |
| Fiber bonding method | Thermal embossing | Thermal embossing | Thermal embossing |
| Basis weight | 100 g/m$^2$ | 100 g/m$^2$ | 100 g/m$^2$ |
| Average smallest fiber diameter (μm) | 25.5 | 27.6 | 28.3 |
| Standard deviation Sn (μm) | 2.5 | 2.4 | 2.6 |
| $Sn/X_{ave}$ | 0.10 | 0.09 | 0.09 |
| Occurrence of filament breakage (times/5 min) | 0 | 0 | 0 |
| Occurrence of fusion bonded fibers (times/5 min) | 0 | 0 | 0 |
| Maximum strength (gf/basis weight) | 21 | 22 | 20 |
| Residual strain (%) | 20 | 20 | 21 |
| Tensile strength (gf/basis weight) | 5.0 | 5.0 | 4.3 |
| Maximum elongation (%) | 540 | 550 | 480 |
| Touch | B | B | B |

| | Ex. 4 | Ex. 5 | Ex. 6 |
|---|---|---|---|
| Polymer (wt %) | TPU-2 (80)<br>SEPS 2002 (15)<br>A-35050 (5) | TPU-2 (45)<br>SEPS 2004 (55) | TPU-4 (100) |
| Fiber configuration | Monocomponent fiber | Monocomponent fiber | Monocomponent fiber |
| Starting temperature for solidifying of TPU | 106.8° C. | 106.8° C. | 103.7° C. |
| Polar-solvent-insoluble particles in TPU | $1.50 \times 10^6$/g | $1.50 \times 10^6$/g | $1.50 \times 10^6$/g |
| Shore A hardness of TPU | 85 | 85 | 86 |
| Fiber forming method | Spunbonding | Spunbonding | Spunbonding |
| Fiber bonding method | Thermal embossing | Thermal embossing | Thermal embossing |
| Basis weight | 100 g/m$^2$ | 100 g/m$^2$ | 100 g/m$^2$ |
| Average smallest fiber diameter (μm) | 29.3 | 28.3 | 26.0 |
| Standard deviation Sn (μm) | 2.6 | 2.6 | 2.5 |
| $Sn/X_{ave}$ | 0.09 | 0.09 | 0.10 |
| Occurrence of filament breakage (times/5 min) | 0 | 0 | 0 |
| Occurrence of fusion bonded fibers (times/5 min) | 0 | 0 | 0 |
| Maximum strength (gf/basis weight) | 20 | 15 | 22 |
| Residual strain (%) | 21 | 27 | 15 |
| Tensile strength (gf/basis weight) | 4.1 | 3.8 | 6.0 |
| Maximum elongation (%) | 400 | 450 | 670 |
| Touch | B | B | B |

| | Ex. 7 | Ex. 8 |
|---|---|---|
| Polymer (wt %) | TPU-4 (100) | TPU-4 (50)<br>PP-1 (50) |
| Fiber configuration | Monocomponent fiber | Eight-segmented conjugate fiber |
| Starting temperature for solidifying of TPU | 103.7° C. | 103.7° C. |
| Polar-solvent-insoluble particles in TPU | $1.50 \times 10^6$/g | $1.50 \times 10^6$/g |
| Shore A hardness of TPU | 86 | 86 |
| Fiber forming method | Spunbonding | Spunbonding |
| Fiber bonding method | Thermal embossing | Thermal embossing |
| Basis weight | 40 g/m$^2$ | 100 g/m$^2$ |
| Average smallest fiber diameter (μm) | 26.0 | 30.0 |
| Standard deviation Sn (μm) | 2.5 | 3.0 |
| $Sn/X_{ave}$ | 0.10 | 0.10 |
| Occurrence of filament breakage (times/5 min) | 0 | 0 |
| Occurrence of fusion bonded fibers (times/5 min) | 0 | 0 |
| Maximum strength (gf/basis weight) | 20 | 28 |
| Residual strain (%) | 15 | 50 |
| Tensile strength (gf/basis weight) | 4.0 | 20 |
| Maximum elongation (%) | 400 | 260 |
| Touch | B | A |

Comparative Example 1

A thermoplastic polyurethane elastomer (trade name: Elastollan XET-275-10MS, available from BASF Japan Ltd.) had a starting temperature for solidifying of 60.2° C. and a hardness of 75 A, and contained $1.40\times10^6$ polar-solvent-insoluble particles per g. This polyurethane elastomer was dehydrated to a water content of 89 ppm by a drier at 100° C. over a period of 8 hours.

A spunbonded nonwoven fabric was prepared and evaluated by the procedure illustrated in Example 1 except that TPU-1 was replaced by Elastollan XET-275-10MS. In this case, the production suffered bad spinnability with many fibers adhering to the spinning tower wall. Further, a part of the spunbonded nonwoven fabric adhered to a thermal embossing roll in the embossing. The results are set forth in Table 2.

Comparative Example 2

A thermoplastic polyurethane elastomer (trade name: Elastollan 1180A-10, available from BASF Japan Ltd.) had a starting temperature for solidifying of 78.4° C. and a hardness of 82 A, and contained $3.20\times10^6$ polar-solvent-insoluble particles per g. This polyurethane elastomer was dehydrated to a water content of 115 ppm by a drier at 100° C. over a period of 8 hours.

Elastollan 1180A-10 was spunbonded under the same conditions as for TPU-1 in Example 1, but many fibers broke in the spinning tower when they had been attenuated to diameters of 50 μm or below. The resultant product was unusable as a nonwoven fabric. Therefore, the spunbonding was carried out again while making fibers thick to diameters in which a nonwoven fabric could be obtained. However, this spunbonding also produced a nonwoven fabric containing broken fibers, deteriorating the touch. The nonwoven fabric was evaluated by the methods described hereinabove. The results are set forth in Table 2.

Comparative Example 3

A thermoplastic polyurethane elastomer (trade name: Elastollan ET-385, available from BASF Japan Ltd.) had a starting temperature for solidifying of 86.9° C. and a hardness of 84 A, and contained $2.80\times10^6$ polar-solvent-insoluble particles per g. This polyurethane elastomer was dehydrated to a water content of 89 ppm by a drier at 100° C. over a period of 8 hours.

Elastollan ET-385 was melt blown under the conditions of a die temperature of 230° C. and an output of 2.0 g/min per nozzle, instead of TPU-1. The fibers were deposited on a collecting surface and automatically fusion bonded together by their heat. Thus, a melt blown nonwoven fabric with a basis weight of 100 g/m$^2$ was obtained.

The nonwoven fabric comprised fine fibers, but the diameters varied broadly among the fibers and the touch was inferior. The results of the evaluations for the nonwoven fabric are set forth in Table 2.

Comparative Example 4

TPU-3 was spunbonded under the same conditions for TPU-1 in Example 1, but many fibers broke in the spinning tower when they had been attenuated to diameters of 50 μm or below. Further, some fibers adhered to a thermal embossing roll in the embossing. The resultant product was so unsatisfactory that some evaluations were avoided. The results are set forth in Table 2.

TABLE 2

| | Comp. Ex. 1 | Comp. Ex. 2 |
|---|---|---|
| Polymer (wt %) | XET-275-10MS (100) | 1180A-10 (100) |
| Fiber configuration | Monocomponent fiber | Monocomponent fiber |
| Starting temperature for solidifying of TPU | 60.2° C. | 78.4° C. |
| Polar-solvent-insoluble particles in TPU | $1.40\times10^6$/g | $3.20\times10^6$/g |
| Shore A hardness of TPU | 75 | 82 |
| Fiber forming method | Spunbonding | Spunbonding |
| Fiber bonding method | Thermal embossing | Thermal embossing |
| Basis weight | 100 g/m$^2$ | 100 g/m$^2$ |
| Average smallest fiber diameter (μm) | 40.1 | 53.0 |
| Standard deviation Sn (μm) | 2.5 | 3.9 |
| $Sn/X_{ave}$ | 0.175 | 0.230 |
| Occurrence of filament breakage (times/5 min) | 0 | 10 |
| Occurrence of welded filaments (times/5 min) | 4 | 0 |
| Maximum strength (gf/basis weight) | 19 | 21 |
| Residual strain (%) | 18 | 19 |
| Tensile strength (gf/basis weight) | 2.0 | 2.6 |
| Maximum elongation (%) | 500 | 490 |
| Touch | D | D |

| | Comp. Ex. 3 | Comp. Ex. 4 |
|---|---|---|
| Polymer (wt %) | ET-385 (100) | TPU-3 (100) |
| Fiber configuration | Monocomponent fiber | Monocomponent fiber |
| Starting temperature for solidifying of TPU | 86.9° C. | 55.2° C. |
| Polar-solvent-insoluble particles in TPU | $2.80\times10^6$/g | $3.50\times10^6$/g |
| Shore A hardness of TPU | 84 | 86 |
| Fiber forming method | Meltblowing | Spunbonding |
| Fiber bonding method | Automatic fusion bonding | Thermal embossing |
| Basis weight | 100 g/m$^2$ | 100 g/m$^2$ |
| Average smallest fiber diameter (μm) | 26.4 | 55.0 |
| Standard deviation Sn (μm) | 4.3 | 4.3 |
| $Sn/X_{ave}$ | 0.163 | 0.258 |
| Occurrence of filament breakage (times/5 min) | 0 | 14 |
| Occurrence of welded filaments (times/5 min) | — | 8 |

TABLE 2-continued

| | | |
|---|---|---|
| Maximum strength (gf/basis weight) | 15 | — |
| Residual strain (%) | 30 | — |
| Tensile strength (gf/basis weight) | 3.7 | — |
| Maximum elongation (%) | 490 | — |
| Touch | C | D |

Example 9

A propylene homopolymer (hereinafter "PP-2") that had MFR (ASTM D1238, 230° C., 2.16 kg load) of 15 g/10 min, a density of 0.91 g/cm$^3$ and a melting point of 160° C., and PP-1 were melt spun by spunbonding technique to form concentric sheath-core conjugate fibers in which the cores consisted of PP-2 and the sheaths consisted of PP-1 with a weight ratio of 10/90 (cores/sheaths). The concentric conjugate fibers were deposited on a collecting surface to form a web (hereinafter "web-1") with a basis weight of 20 g/m$^2$.

Subsequently, TPU-4 was melt spun under the same conditions as in Example 6 and deposited on the web-1 to form another web (hereinafter "web-2") with a basis weight of 40 g/m$^2$. Thereafter, PP-1 and PP-2 were melt spun into concentric sheath-core conjugate fibers as described above and deposited on the web-2 to form an additional web (hereinafter "web-3") with a basis weight of 20 g/m$^2$.

The three-layer deposit was embossed at 100° C. with an embossing roll (embossing area percentage: 7%, roll diameter: 150 mm, boss pitches: 2.1 mm transversely and longitudinally, boss shape: rhombus). Thus, a laminate of extensible nonwoven fabric/elastic nonwoven fabric/extensible nonwoven fabric, with a basis weight of 80 g/m$^2$, was obtained.

The spunbonded nonwoven fabric laminate was evaluated by the aforementioned methods. For the laminate, the tensile test was carried out twice under the identical conditions: first to measure a tensile strength at 100% elongation and second to measure a tensile strength at 100% elongation after relaxed to its original length in the first test. The results are set forth in Table 3.

TABLE 3

| | | Ex. 9 | |
|---|---|---|---|
| Fiber forming method | | Spunbonding | |
| First layer | Fiber configuration | Concentric sheath-core conjugate fiber | |
| | | Core | Sheath |
| | Polymer (wt %) | PP-2 (100) | PP-1 (100) |
| | Weight ratio (%) | 10 | 90 |
| | Basis weight | 20 g/m$^2$ | |
| Second layer | Fiber configuration | Monocomponent fiber | |
| | Polymer (wt %) | TPU-4 (100) | |
| | Starting temperature for solidifying of TPU | 103.7° C. | |
| | Polar-solvent-insoluble particles in TPU | $1.50 \times 10^6$/g | |
| | Shore A hardness of TPU | 86 | |
| | Basis weight | 40 g/m$^2$ | |
| | Average smallest fiber diameter (μm) | 26.0 | |
| | Standard deviation Sn (μm) | 2.5 | |
| | $Sn/X_{ave}$ | 0.10 | |
| | Occurrence of filament breakage (times/5 min) | 0 | |
| | Occurrence of welded filaments (times/5 min) | 0 | |
| Third layer | Fiber configuration | Concentric sheath-core conjugate fiber | |
| | | Core | Sheath |

TABLE 3-continued

| | Ex. 9 | |
|---|---|---|
| Polymer (wt %) | PP-2 (100) | PP-1 (100) |
| Weight ratio (%) | 10 | 90 |
| Basis weight | 20 g/m$^2$ | |
| Bonding method | Thermal embossing | |
| Maximum strength (gf/basis weight) | 16 | |
| Residual strain (%) | 20 | |
| Tensile strength (1st measurement) (gf/basis weight) | 12.0 | |
| Tensile strength (2nd measurement) (gf/basis weight) | 10.0 | |
| Maximum elongation (%) | 200 | |
| Touch | A | |

INDUSTRIAL APPLICABILITY

The elastic nonwoven fabric according to the invention has high elasticity, small residual strain, excellent flexibility, narrow fiber diameter distribution and pleasant touch. Therefore, it can be suitably used in hygiene materials, industrial materials, garments and materials for sporting goods.

What is claimed is:

1. A spunbonded elastic nonwoven fabric comprising fibers formed from a polymer comprising a thermoplastic polyurethane elastomer, said thermoplastic polyurethane elastomer having a starting temperature for solidifying of 65° C. or above as measured by a differential scanning calorimeter (DSC) and containing $3.00\times10^4$ or more and $3.00\times10^6$ or less polar-solvent-insoluble particles per gram as counted on a particle size distribution analyzer, which is based on an electrical sensing zone method, equipped with an aperture tube having an orifice of 100 μm in diameter, and said fibers having diameters such that the standard deviation of fiber diameters (Sn) divided by the average fiber diameter ($X_{ave}$) ($Sn/X_{ave}$) gives a value of 0.15 or less.

2. The elastic nonwoven fabric according to claim 1, wherein the polymer contains the thermoplastic polyurethane elastomer in an amount of 10 wt % or more.

3. The elastic nonwoven fabric according to claim 1, wherein on the thermoplastic polyurethane elastomer, a total heat of fusion (a) determined from endothermic peaks within the temperature range of from 90 to 140° C. and a total heat of fusion (b) determined from endothermic peaks within the temperature range of from above 140 to 220° C., which are measured by a differential scanning calorimeter (DSC), satisfy the following relation (1):

$$a/(a+b)\times100\leqq80 \quad (1).$$

4. A hygiene material comprising the elastic nonwoven fabric described in claim 1.

5. A production method for an elastic nonwoven fabric comprising fibers formed from a polymer comprising a thermoplastic polyurethane elastomer by spunbonding the polymer, wherein the thermoplastic polyurethane elastomer has a starting temperature for solidifying of 65° C. or above as measured by a differential scanning calorimeter (DSC) and contains $3.00\times10^4$ or more and $3.00\times10^6$ or less polar-solvent-insoluble particles per gram as counted on a particle size distribution analyzer, which is based on an electrical sensing zone method, equipped with an aperture tube having an orifice of 100 μm in diameter, and wherein the fibers have diameters such that the standard deviation of fiber diameters (Sn) divided by the average fiber diameter ($X_{ave}$) ($Sn/X_{ave}$) gives a value of 0.15 or less.

6. A spunbonding processible thermoplastic polyurethane elastomer that has a starting temperature for solidifying of 65° C. or above as measured by a differential scanning calorimeter (DSC), contains $3.00\times10^4$ or more and $3.00\times10^6$ or less polar-solvent-insoluble particles per gram as counted on a particle size distribution analyzer, which is based on an electrical sensing zone method, equipped with an aperture tube having an orifice of 100 μm in diameter, and enables production of spunbonded elastic nonwoven fabrics in which the standard deviation of fiber diameters (Sn) divided by the average fiber diameter ($X_{ave}$) ($Sn/X_{ave}$) gives a value of 0.15 or less.

7. The elastic nonwoven fabric according to claim 2, wherein on the thermoplastic polyurethane elastomer, a total heat of fusion (a) determined from endothermic peaks within the temperature range of from 90 to 140° C. and a total heat of fusion (b) determined from endothermic peaks within the temperature range of from above 140 to 220° C., which are measured by a differential scanning calorimeter (DSC), satisfy the following relation (1):

$$a/(a+b)\times100\leqq80 \quad (1).$$

8. A hygiene material comprising the elastic nonwoven fabric described in claim 2.

9. A hygiene material comprising the elastic nonwoven fabric described in claim 3.

10. A hygiene material comprising the elastic nonwoven fabric described in claim 7.

11. A spunbonded elastic nonwoven fabric comprising fibers formed from a polymer comprising a thermoplastic polyurethane elastomer, said thermoplastic polyurethane elastomer having a starting temperature for solidifying of 65° C. or above as measured by a differential scanning calorimeter (DSC) and containing $3.00\times10^4$ or more and $3.00\times10^6$ or less polar-solvent-insoluble particles per gram as counted on a particle size distribution analyzer, which is based on an electrical sensing zone method, equipped with an aperture tube having an orifice of 100 μm in diameter, and said fibers having diameters such that the standard deviation of fiber diameters (Sn) divided by the average fiber diameter ($X_{ave}$) ($Sn/X_{ave}$) gives a value of 0.12 or less.

* * * * *